US007223081B2

(12) United States Patent
Lee et al.

(10) Patent No.: US 7,223,081 B2
(45) **Date of Patent: *May 29, 2007**

(54) VARIABLE CAPACITY ROTARY COMPRESSOR

(75) Inventors: In Ju Lee, Yongin (KR); Seung Kap Lee, Suwon (KR); Cheol Woo Kim, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 214 days.

This patent is subject to a terminal disclaimer.

(21) Appl. No.: 10/830,016

(22) Filed: Apr. 23, 2004

(65) Prior Publication Data

US 2005/0019192 A1 Jan. 27, 2005

(30) Foreign Application Priority Data

Jul. 24, 2003 (KR) ..... 10-2003-0050983

(51) Int. Cl.
*F04B 49/00* (2006.01)

(52) U.S. Cl. ..... 417/218; 417/221; 417/223; 417/287; 417/410.3; 418/29; 418/60; 418/69

(58) Field of Classification Search ..... 418/23, 418/29, 60, 69; 417/218, 221, 223, 287, 417/410.3

See application file for complete search history.

(56) References Cited

U.S. PATENT DOCUMENTS 4,780,067 A * 10/1988 Suzuki et al. ..... 418/60
5,871,342 A 2/1999 Harte et al.
6,860,724 B2 * 3/2005 Cho et al. ..... 417/223

FOREIGN PATENT DOCUMENTS

JP 59147895 A * 8/1984 ..... 418/60
JP 63057889 A * 3/1988 ..... 418/60

* cited by examiner

*Primary Examiner*—Theresa Trieu
(74) *Attorney, Agent, or Firm*—Staas & Halsey LLP

(57) ABSTRACT

A variable capacity rotary compressor to prevent eccentric bushes from rotating faster than a rotating shaft, and includes upper and lower compression chambers having different interior capacities thereof, and the rotating shaft with upper and lower eccentric cams being provided thereon to be eccentric from the rotating shaft in a common direction. Upper and lower eccentric bushes are fitted over the upper and lower eccentric cams, respectively, with a slot provided there between. A locking pin changes a position of the upper or lower eccentric bush to a maximum eccentric position. Upper and lower brake units are, respectively, provided between the upper eccentric cam and the upper eccentric bush, and between the lower eccentric cam and the lower eccentric bush. The upper and lower brake units, respectively, include first and second upper brake balls, and first and second lower brake balls, to restrain the upper and lower eccentric bushes.

23 Claims, 8 Drawing Sheets

VARIABLE CAPACITY ROTARY COMPRESSOR

CROSS-REFERENCE TO RELATED APPLICATIONS

This application claims the benefit of Korean Application No. 2003-50983, filed Jul. 24, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities thereof, by an eccentric unit mounted to a rotating shaft.

2. Description of the Related Art

Generally, a compressor is installed in refrigeration systems, such as air conditioners and refrigerators, which operate to cool air in a given space using a refrigeration cycle. In refrigeration systems, the compressor operates to compress a refrigerant which circulates through a refrigeration circuit. A cooling capacity of the refrigeration system is determined according to a compression capacity of the compressor. Thus, when the compressor is designed to vary a compression capacity thereof as desired, the refrigeration system operates under an optimum condition considering several factors, such as a difference between a practical temperature and a predetermined temperature, thus, allowing air in the given space to be efficiently cooled, and saving energy.

A variety of compressors are used in the refrigeration systems. The compressors are typically classified into two types, (i.e., rotary compressors and reciprocating compressors). The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute an eccentric rotation in the compression chamber. A gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor which is constructed so that a compression operation is executed in either of two compression chambers having different capacities thereof by an eccentric unit mounted to a rotating shaft, thus varying a compression capacity as desired.

It is another aspect to provide a variable capacity rotary compressor, which is designed to prevent an eccentric bush from rotating faster than a rotating shaft in a specific range, due to a variance in a pressure of a compression chamber as the rotating shaft rotates.

The above and/or other aspects are achieved by providing a variable capacity rotary compressor, including upper and lower compression chambers, a rotating shaft, upper and lower eccentric cams, upper and lower eccentric bushes, a slot, a locking pin, and upper and lower brake units. The upper and lower compression chambers have different interior capacities thereof. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin operates to change a position of the upper or lower eccentric bush to a maximum eccentric position, in cooperation with the slot. The upper and lower brake units simultaneously operate to prevent either of the upper and lower eccentric bushes from slipping over the upper or lower eccentric cam, respectively.

The upper brake unit may include first and second upper pockets formed at first predetermined positions of the upper eccentric cam, first and second upper brake balls movably set in the first and second upper pockets, respectively, and first and second upper brake holes formed at second predetermined positions of the upper eccentric bush to have a diameter smaller than that of each of the first and second upper brake balls. The lower brake unit may include first and second lower pockets formed at third predetermined positions of the lower eccentric cam, first and second lower brake balls movably set in the first and second lower pockets, respectively, and first and second lower brake holes formed at fourth predetermined positions of the lower eccentric bush to have a diameter smaller than that of each of the first and second lower brake balls.

The locking pin may project from the rotating shaft at a position between the upper and lower eccentric cams. The slot may be provided between the upper and lower eccentric bushes to engage with the locking pin, and may have a length to allow, an angle between a first line extending from a first end of the slot to a center of the rotating shaft and a second line extending from a second end of the slot to the center of the rotating shaft, to be 180°.

The first and second upper pockets may be formed on the upper eccentric cam to be opposite to each other, and the first and second lower pockets may be formed on the lower eccentric cam to be opposite to each other at common angular positions as that of the first and second upper pockets.

Similarly, the first and second upper brake holes may be formed on the upper eccentric bush to be opposite to each other, and the first and second lower brake holes may be formed on the lower eccentric bush to be opposite to each other at common angular positions as that of the first and second upper brake holes.

Therefore, when the locking pin contacts the first end of the slot and the upper eccentric bush rotates to be maximally eccentrically from the rotating shaft, the first and second upper brake balls may be inserted into the first and second upper brake holes, respectively, and the first and second lower brake balls may be inserted into the first and second lower brakes holes, respectively, by a centrifugal force, thus preventing the upper eccentric bush from slipping.

When the locking pin contacts the second end of the slot and the lower eccentric bush rotates to be maximally eccentrically from the rotating shaft, the first and second upper brake balls may be inserted into the second and first upper brake holes, respectively, and the first and second lower brake balls may be inserted into the second and first lower brakes holes, respectively, by the centrifugal force, thus preventing the lower eccentric bush from slipping.

Further, an oil passage may be axially formed along the rotating shaft. In this case, the first and second upper pockets may communicate with the oil passage via first and second upper connecting passages, and the first and second lower pockets may communicate with the oil passage via first and second lower connecting passages, thus allowing an oil pressure and the centrifugal force to act on the first and second upper brake balls and the first and second lower brake balls.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
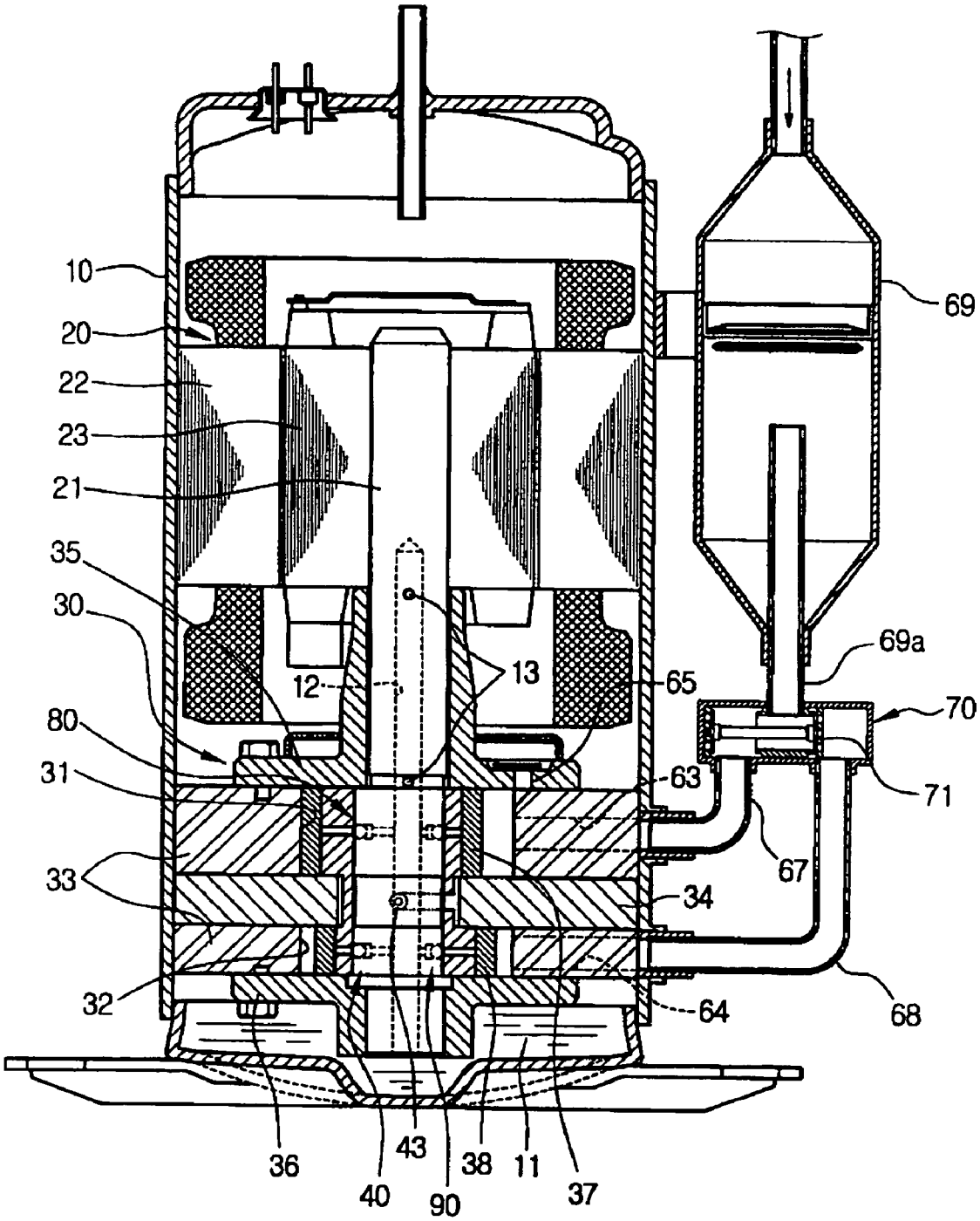
FIG. 1 is a sectional view showing an interior construction of a variable capacity rotary compressor, according to an embodiment of the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

FIG. 1 is a sectional view showing a variable capacity rotary compressor, according to an embodiment of the present invention. As illustrated in FIG. 1, the variable capacity rotary compressor includes a hermetic casing 10, with a drive unit 20 and a compressing unit 30 being installed in the hermetic casing 10. The drive unit 20 generates a rotating force, and the compressing unit 30 compresses gas using the rotating force of the drive unit 20. The drive unit 20 includes a cylindrical stator 22, a rotor 23, and a rotating shaft 21. The cylindrical stator 22 is fixedly mounted to an inner surface of the hermetic casing 10. The rotor 23 is rotatably installed in the cylindrical stator 22. The rotating shaft 21 is installed to pass through a center of the rotor 23, and rotates along with the rotor 23 in a first direction, which is counterclockwise in the drawings, or in a second direction, which is clockwise in the drawings.

The compressing unit 30 includes a housing 33, upper and lower flanges 35 and 36, and a partition plate 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition plate 34 is interposed between the upper and lower compression chambers 31 and 32 to partition the upper and lower compression chambers 31 and 32 thereby.

The upper compression chamber 31 may be higher in a vertical direction than that of the lower compression chamber 32, thus the upper compression chamber 31 may have a larger capacity than that of the lower compression chamber 32. Therefore, a larger amount of gas may be compressed in the upper compression chamber 31 in comparison with the lower compression chamber 32, thus allowing the variable capacity rotary compressor to have a variable capacity.

Further, when the lower compression chamber 32 is higher than that of the upper compression chamber 31, the lower compression chamber 32 has a larger capacity than that of the upper compression chamber 31, thus allowing a larger amount of gas to be compressed in the lower compression chamber 32.

Further, an eccentric unit 40 is placed in the upper and lower compression chambers 31 and 32 to execute a compressing operation in either the upper or lower compression chamber 31 or 32, according to a rotating direction of the rotating shaft 21. Upper and lower brake units 80 and 90 are provided at predetermined positions of the eccentric unit 40 to smoothly operate the eccentric unit 40. A construction and an operation of the eccentric unit 40 and the upper and lower brake units 80 and 90 will be described later herein, with reference to FIGS. 2 to 8.

Upper and lower rollers 37 and 38 are placed in the upper and lower compression chambers 31 and 32, respectively, to be rotatably fitted over the eccentric unit 40. Upper inlet and upper outlet ports 63 and 65 (see FIG. 3) are formed at predetermined positions of the housing 33 to communicate with the upper compression chamber 31. Lower inlet and lower outlet ports 64 and 66 (see FIG. 6) are formed at predetermined positions of the housing 33 to communicate with the lower compression chamber 32.

Figure 3:
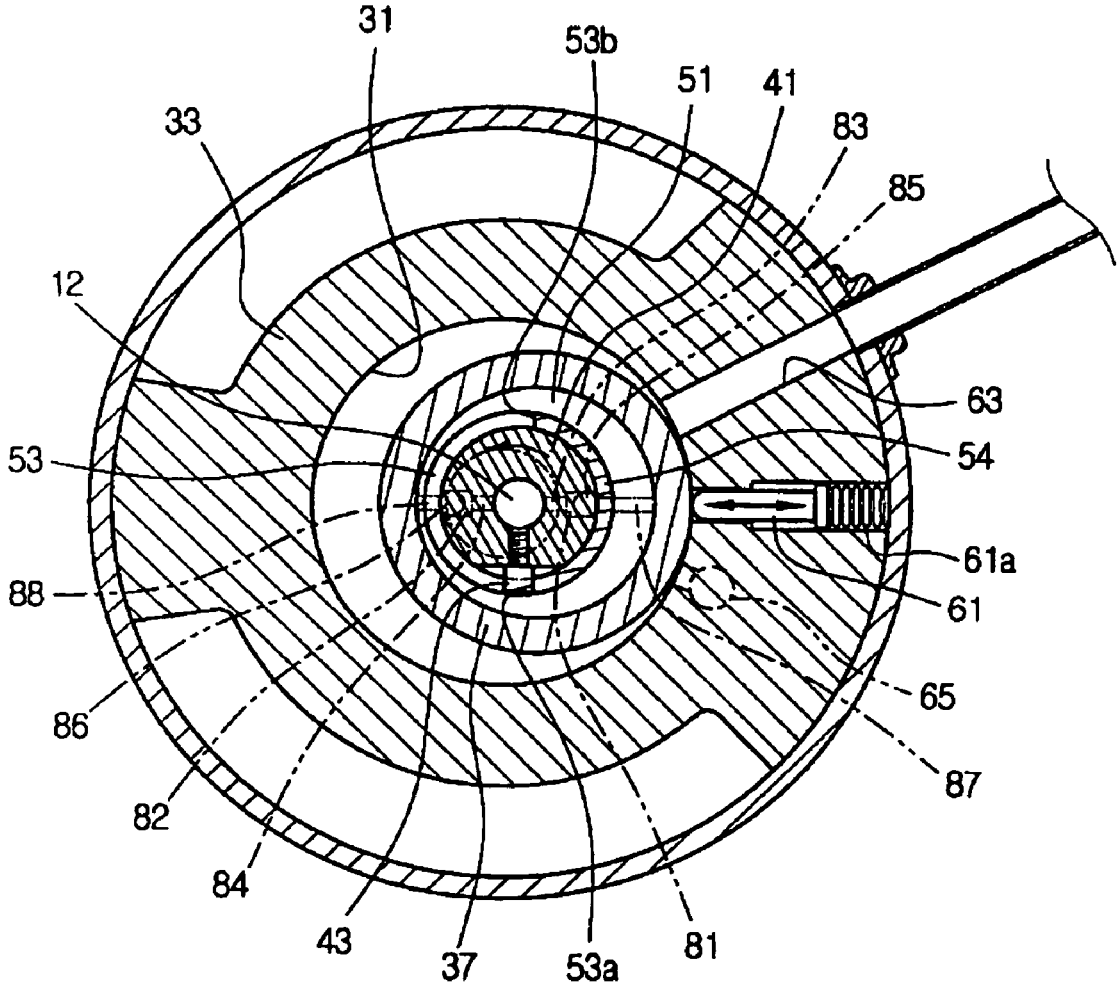
FIG. 3 is a sectional view showing an upper compression chamber in which a compression operation is executed without a slippage by the eccentric unit of FIG. 2, when the rotating shaft rotates in a first direction.

An upper vane 61 is positioned between the upper inlet and upper outlet ports 63 and 65, and is biased in a radial direction by an upper support spring 61*a* to be in a close contact with the upper roller 37 (see FIG. 3). Further, a lower vane 62 is positioned between the lower inlet and lower outlet ports 64 and 66, and is biased in a radial direction by a lower support spring 62*a* to be in a close contact with the lower roller 38 (see FIG. 6).

Further, a refrigerant outlet pipe 69*a* extends from an accumulator 69 which contains a refrigerant therein. Of the refrigerant contained in the accumulator 69, only a gas refrigerant flows into the variable capacity rotary compressor through the refrigerant outlet pipe 69*a*. At a predetermined position of the refrigerant outlet pipe 69*a* is installed a path control unit 70. The path control unit 70 operates to open or to close first or second intake paths 67 or 68, thus supplying the gas refrigerant to one of the upper inlet port 63 of the upper compression chamber 31 and the lower inlet port 64 of the lower compression chamber 32 in which a compression operation is executed. A valve unit 71 is installed in the path control unit 70 to be movable in a horizontal direction. The valve unit 71 operates to open either the first or second intake paths 67 or 68 by a difference in a pressure between the first intake path 67 connected to the upper inlet port 63 and the second intake path 68 connected to the lower inlet port 64, thus supplying the gas refrigerant to the upper inlet port 63 or lower inlet port 64.

Further, a predetermined amount of oil 11 is contained in a lower portion of the hermetic casing 10 to lubricate and to cool several contact parts of the compressing part 30. An oil passage 12 is axially formed along the rotating shaft 21 to be eccentric from a central axis C1-C1 of the rotating shaft 21, and operates to move the oil 11 upward by a centrifugal force resulting from a rotation of the rotating shaft 21. A plurality of oil supply holes 13 are formed in the rotating shaft 21 in radial directions to communicate with the oil passage 12, thus supplying the oil 11, which flows upward through the oil passage 12, to the contact parts.

A construction of the rotating shaft 21 and the eccentric unit 40 according to the embodiment of the present invention will be described in the following with reference to FIG. 2.

Figure 2:
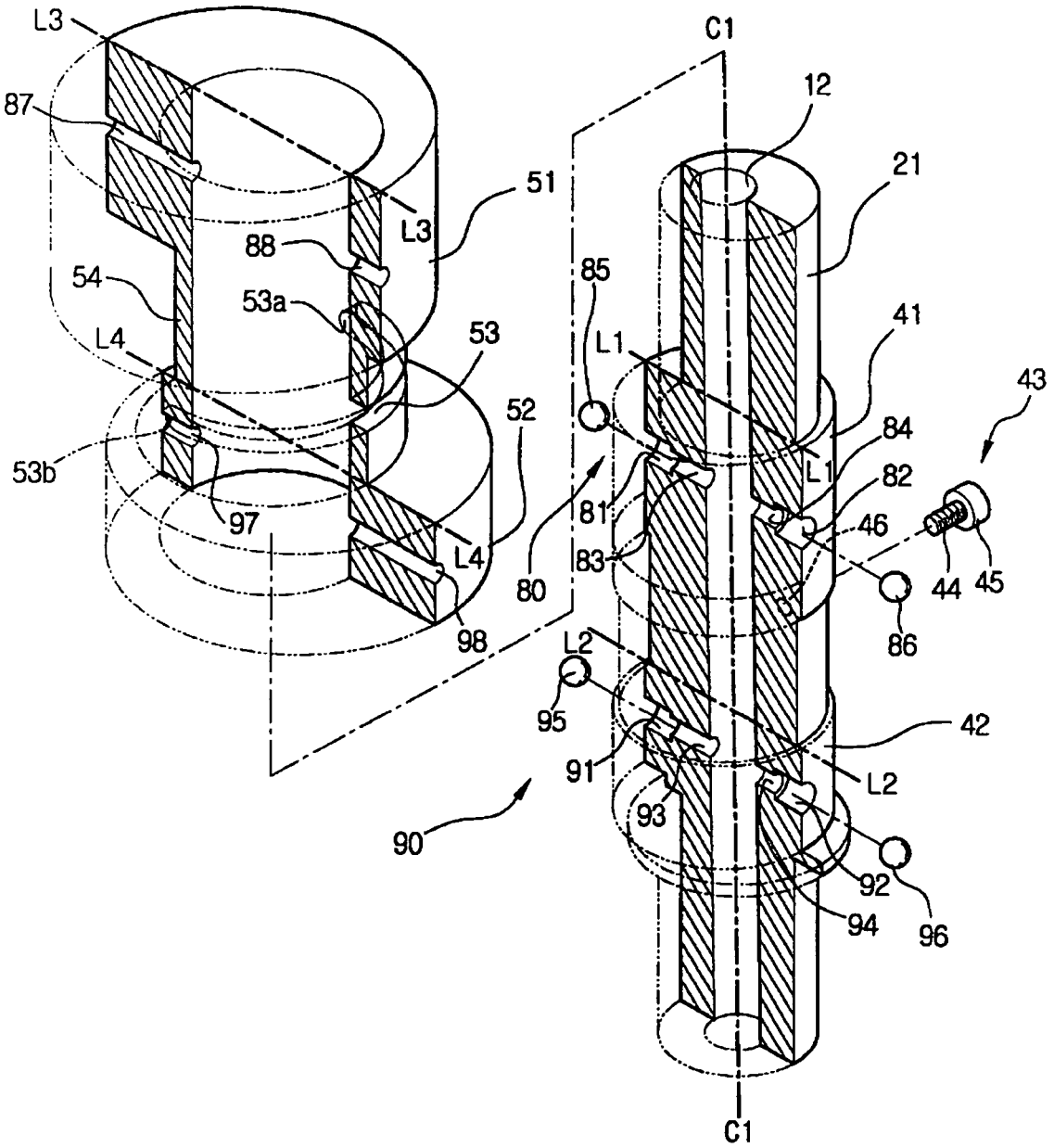
FIG. 2 is an exploded perspective view of an eccentric unit included in the variable capacity rotary compressor of FIG. 1, in which upper and lower eccentric bushes of the eccentric unit are separated from a rotating shaft.

FIG. 2 is an exploded perspective view of the eccentric unit 40 included in the variable capacity rotary compressor of FIG. 1, in which upper and lower eccentric bushes 51 and 52 of the eccentric unit 40 are separated from the rotating shaft 21. As illustrated in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43. The eccentric unit 40 also includes the upper and lower brake units 80 and 90. The upper and lower brake units 80 and 90 operate to prevent the upper eccentric bush 51 and lower eccentric bush 52 from slipping over the upper eccentric cam 41 and lower eccentric cam 42, respectively, at corresponding predetermined positions. This slipping may be due to variance in pressure of one or both of the upper and lower compression chambers 31 and 32 as the rotating shaft 21 rotates.

The upper and lower eccentric cams 41 and 42 integrally are fitted over the rotating shaft 21 to be eccentric from the central axis C1-C1 of the rotating shaft 21. The upper and lower eccentric cams 41 and 42 are positioned to correspond an upper eccentric line L1-L1 of the upper eccentric cam 41 and to a lower eccentric line L2-L2 of the lower eccentric cam 42. In this case, the upper eccentric line L1-L1 is defined as a line to connect a maximum eccentric part of the upper eccentric cam 41, which maximally projects from the rotating shaft 21, to a minimum eccentric part of the upper eccentric cam 41, which minimally projects from the rotating shaft 21. Further, the lower eccentric line L2-L2 is defined as a line to connect a maximum eccentric part of the lower eccentric cam 42, which maximally projects from the rotating shaft 21, to a minimum eccentric part of the lower eccentric cam 42, which minimally projects from the rotating shaft 21.

The locking pin 43 includes a threaded shank 44 and a head 45. The head 45 has a slightly larger diameter than the threaded shank 44, and is formed at an end of the threaded shank 44. Further, a threaded hole 46 is formed on the rotating shaft 21 between the upper and lower eccentric cams 41 and 42 to be at about 90° with the maximum eccentric parts of the upper and lower eccentric cams 41 and 42. The threaded shank 44 of the locking pin 43 is inserted into the threaded hole 46 in a screw-type fastening method to lock the locking pin 43 to the rotating shaft 21.

The upper and lower eccentric bushes 51 and 52 are integrated with each other by a connecting part 54 which connects the upper and lower eccentric bushes 51 and 52 to each other. The slot 53 is formed around a part of the connecting part 54, and has a width which is slightly larger than a diameter of the head 45 of the locking pin 43.

Thus, when the upper and lower eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the locking pin 43 is mounted to the rotating shaft 21 while engaging with the slot 53.

When the rotating shaft 21 rotates in the first direction or the second direction in such a state, the upper and lower eccentric bushes 51 and 52 are not rotated until the locking pin 43 comes into contact with one of first and second ends 53*a* and 53*b* of the slot 53. When the locking pin 43 comes into contact with the first end 53*a* or the second end 53*b* of the slot 53, the upper and lower eccentric bushes 51 and 52 rotate in the first direction or the second direction along with the rotating shaft 21.

In this case, a first eccentric line L3-L3, which connects a maximum eccentric part of the upper eccentric bush 51 to a minimum eccentric part thereof, is placed at about 90° with a line which connects the first end 53*a* of the slot 53 to a center of the connecting part 54. Further, a second eccentric line L4-L4, which connects a maximum eccentric part of the lower eccentric bush 52 to a minimum eccentric part thereof, is placed at about 90° with a line which connects the second end 53*b* of the slot 53 to the center of the connecting part 54.

Further, the first eccentric line L3-L3 of the upper eccentric bush 51 and the second eccentric line L4-L4 of the lower eccentric bush 52 are positioned on a common plane, but the maximum eccentric part of the upper eccentric bush 51 is arranged to be opposite to the maximum eccentric part of the lower eccentric bush 52. An angle between a line extending from the first end 53*a* of the slot 53 to a center of the rotating shaft 21 and a line extending from the second end 53*b* of the slot 53 to the center of the rotating shaft 21 is 180°. The slot 53 is formed around a part of the connecting part 54.

In the eccentric unit 40 constructed as described above, the upper brake unit 80 is provided between the upper eccentric cam 41 and the upper eccentric bush 51, while the lower brake unit 90 is provided between the lower eccentric cam 42 and the lower eccentric bush 52.

The upper brake unit 80 includes first and second upper pockets 81 and 82. The first and second upper pockets 81 and 82 are bored on an outer surface of the upper eccentric cam 41 to be opposite to each other. First and second upper brake balls 85 and 86 are set in the first and second upper pockets 81 and 82, respectively. First and second upper brake holes 87 and 88 are bored on an inner surface of the upper eccentric bush 51 to be opposite to each other.

The first and second upper brake balls 85 and 86 are slightly smaller than the first and second upper pockets 81 and 82 while being slightly larger than the first and second upper brake holes 87 and 88, respectively, in a diameter thereof. Thus, the first and second upper brake balls 85 and 86 are movably set in the first and second upper pockets 81 and 82, respectively. When a centrifugal force is generated in such a state, the first and second upper brake balls 85 and 86 move outward to be inserted into the first and second upper brake holes 87 and 88, respectively, thus preventing one of the upper eccentric bush 51 from slipping over the upper eccentric cam 41 and the lower eccentric bush 52 from slipping over the lower eccentric cam 42.

The first and second upper pockets 81 and 82 are designed to communicate with the oil passage 12 which is axially formed along the rotating shaft 21, via first and second upper connecting passages 83 and 84, to enhance operational effects of the first and second upper brake balls 85 and 86 and to prevent the upper and lower eccentric bushes 51 and 52 from slipping. According to the above-mentioned construction, the oil 11 is supplied from the oil passage 12 through the first and second upper connecting passages 83 and 84 to the first and second upper pockets 81 and 82. At this time, an oil pressure resulting from the oil 11 acts on the first and second upper brake balls 85 and 86 to move the first and second upper brake balls 85 and 86 in an outward direction. Thus, the first and second upper brake balls 85 and 86 come into a closer contact (i.e., a pressure contact) with the first and second upper brake holes 87 and 88, respectively, thus effectively preventing the upper eccentric bush 51 from slipping over the upper eccentric cam 41 or the lower eccentric bush 52 from slipping over the lower eccentric cam 42.

Since each of the first and second upper brake holes 87 and 88 is bored from an inner surface of the upper eccentric bush 51 to an outer surface thereof, the oil 11 fed into the first and second upper pockets 81 and 82 flows to an exterior of the upper eccentric bush 51 through gaps between the first and second upper brake balls 85 and 86 and the first and second upper brake holes 87 and 88. Such a construction prevents the first and second upper brake balls 85 and 86 from being fixed in the first and second upper brake holes 87 and 88, respectively, by an oil pressure, while allowing a contact part between the upper eccentric bush 51 and the upper roller 37 (see FIG. 3) fitted over the upper eccentric bush 51 to be lubricated.

The first and second upper pockets 81 and 82, which are formed along the upper eccentric line L1-L1 of the upper eccentric cam 41 to be opposite to each other, are arranged at positions which are angularly spaced apart from the locking pin 43 by about 90°. Further, the first and second upper brake holes 87 and 88, which are formed along the first eccentric line L3-L3 of the upper eccentric bush 51 to be opposite to each other, are arranged at positions which are angularly spaced apart from the first end 53*a* of the slot 53 by about 90°.

When the rotating shaft 21 rotates in the first direction, which is counterclockwise in FIG. 2, the first upper pocket 81 is positioned leading the locking pin 43 while being angularly spaced apart from the locking pin 43 by a first angle of 90°. Further, the second upper pocket 82 is positioned following the locking pin 43 while being angularly spaced apart from the locking pin 43 by a second angle of 90°. Further, the first upper brake hole 87 is positioned leading the first end 53*a* of the slot 53 while being angularly spaced apart from the first end 53*a* by a third angle of 90°. The second upper brake hole 88 is positioned following the first end 53*a* of the slot 53 while being angularly spaced apart from the first end 53*a* by a fourth angle of 90°.

Thus, when the locking pin 43 contacts the first end 53*a* of the slot 53 and the rotating shaft 21 rotates along with the upper and lower eccentric bushes 51 and 52 in the first direction, the first upper pocket 81 is aligned with the first upper brake hole 87 and the second upper pocket 82 is aligned with the second upper brake hole 88. At this time, the first and second upper brake balls 85 and 86 are inserted into the first and second upper brake holes 87 and 88, respectively, thus preventing the upper eccentric bush 51 from slipping.

Conversely, when the locking pin 43 contacts the second end 53*b* of the slot 53 and the rotating shaft 21 rotates along with the upper and lower eccentric bushes 51 and 52 in the second direction, the first upper pocket 81 is aligned with the second upper brake hole 88 and the second upper pocket 82 is aligned with the first upper brake hole 87. At this time, the first and second upper brake balls 85 and 86 are inserted into the second and first upper brake holes 88 and 87, respectively, thus preventing the lower eccentric bush 52 from slipping.

A general construction of the lower brake unit 90 remains the same as that of the upper brake unit 80, except that the lower brake unit 90 is provided between the lower eccentric cam 42 and the lower eccentric bush 52.

The lower brake unit 90 includes first and second lower pockets 91 and 92. The first and second lower pockets 91 and 92 are bored on an outer surface of the lower eccentric cam 42 to be opposite to each other. First and second lower brake balls 95 and 96 are set in the first and second lower pockets 91 and 92, respectively. First and second lower brake holes 97 and 98 are bored on an inner surface of the lower eccentric bush 52 to be opposite to each other.

The first and second lower brake balls 95 and 96 have a diameter slightly smaller than those of the first and second lower pockets 91 and 92 while the diameter of the first and second lower brake balls are slightly larger than those of the first and second lower brake holes 97 and 98, respectively. Thus, the first and second lower brake balls 95 and 96 are movably set in the first and second lower pockets 91 and 92, respectively. When a centrifugal force is generated in such a state, the first and second lower brake balls 95 and 96 move outward to be inserted into the first and second lower brake holes 97 and 98, respectively, thus preventing the upper eccentric bush 51 or the lower eccentric bush 52 from slipping over the upper eccentric cam 41 or the lower eccentric cam 42, respectively.

The first and second lower pockets 91 and 92 are designed to communicate with the oil passage 12 which is axially formed along the rotating shaft 21, via first and second lower connecting passages 93 and 94, to enhance operational effects of the first and second lower brake balls 95 and 96 which, respectively, prevents the upper and lower eccentric bushes 51 and/or 52 from slipping. According to the above-mentioned construction, the oil 11 is supplied from the oil passage 12 through the first and second lower connecting passages 93 and 94 to the first and second lower pockets 91 and 92. At this time, an oil pressure resulting from the oil 11 acts on the first and second lower brake balls 95 and 96 to move the first and second lower brake balls 95 and 96 in an outward direction. Thus, the first and second lower brake balls 95 and 96 come into a closer contact (i.e., a pressure contact) with the first and second lower brake holes 97 and 98, respectively, thus effectively preventing the upper eccentric bush 51 or the lower eccentric bush 52 from slipping over the upper eccentric cam 41 or the lower eccentric cam 42, respectively.

Since each of the first and second lower brake holes 97 and 98 is bored from the an inner surface of the lower eccentric bush 52 to an outer surface thereof, the oil 11 fed into the first and second lower pockets 91 and 92 flows to an exterior of the lower eccentric bush 52 through gaps between the first and second lower brake balls 95 and 96 and the first and second lower brake holes 97 and 98. Such a construction prevents the first and second lower brake balls 95 and 96 from being fixed in the first and second lower brake holes 97 and 98, respectively, by an oil pressure, while allowing a contact part between the lower eccentric bush 52 and the lower roller 38 (see FIG. 6) fitted over the lower eccentric bush 52 to be lubricated.

The first and second lower pockets 91 and 92, which are formed along the upper eccentric line L2-L2 of the lower eccentric cam 42 to be opposite to each other, are arranged at positions which are angularly spaced apart from the locking pin 43 by about 90°. Further, the first and second lower brake holes 97 and 98, which are formed along the first eccentric line L3-L3 of the lower eccentric bush 52 to be opposite to each other, are arranged at positions which are angularly spaced apart from the second end 53*b* of the slot 53 by about 90°.

When the rotating shaft 21 rotates in the second direction, which is clockwise in FIG. 2, the first lower pocket 91 is positioned leading the locking pin 43 while being angularly spaced apart from the locking pin 43 by a fifth angle of 90°. Further, the second lower pocket 92 is positioned following the locking pin 43 while being angularly spaced apart from the locking pin 43 at a sixth angle of 90°. Further, the first lower brake hole 97 is positioned leading the second end 53*b* of the slot 53 while being angularly spaced apart from the second end 53*b* by a seventh angle of 90°. The second lower brake hole 98 is positioned following the second end 53*b* of the slot 53 while being angularly spaced apart from the second end 53*b* by an eighth angle of 90°.

Thus, when the locking pin 43 contacts the second end 53*b* of the slot 53 and the rotating shaft 21 rotates along with the upper and lower eccentric bushes 51 and 52 in the second direction, the first lower pocket 91 is aligned with the second lower brake hole 98 and the second lower pocket 92 is aligned with the first lower brake hole 97. At this time, the first and second lower brake balls 95 and 96 are inserted into the second and first lower brake holes 98 and 97, respectively, thus preventing the lower eccentric bush 52 from slipping.

Conversely, when the locking pin 43 contacts the first end 53*a* of the slot 53 and the rotating shaft 21 rotates along with the upper and lower eccentric bushes 51 and 52 in the first direction, the first lower pocket 91 is aligned with the first lower brake hole 97 and the second lower pocket 92 is aligned with the second lower brake hole 98. At this time, the first and second lower brake balls 95 and 96 are inserted into the first and second lower brake holes 97 and 98, respectively, thus preventing the upper eccentric bush 51 from slipping.

The operation of compressing a gas refrigerant in the upper or lower compression chamber 31 or 32 by the eccentric unit 40 according to the embodiment of the present invention will be described in the following with reference to FIGS. 3 to 8.

Figure 4:
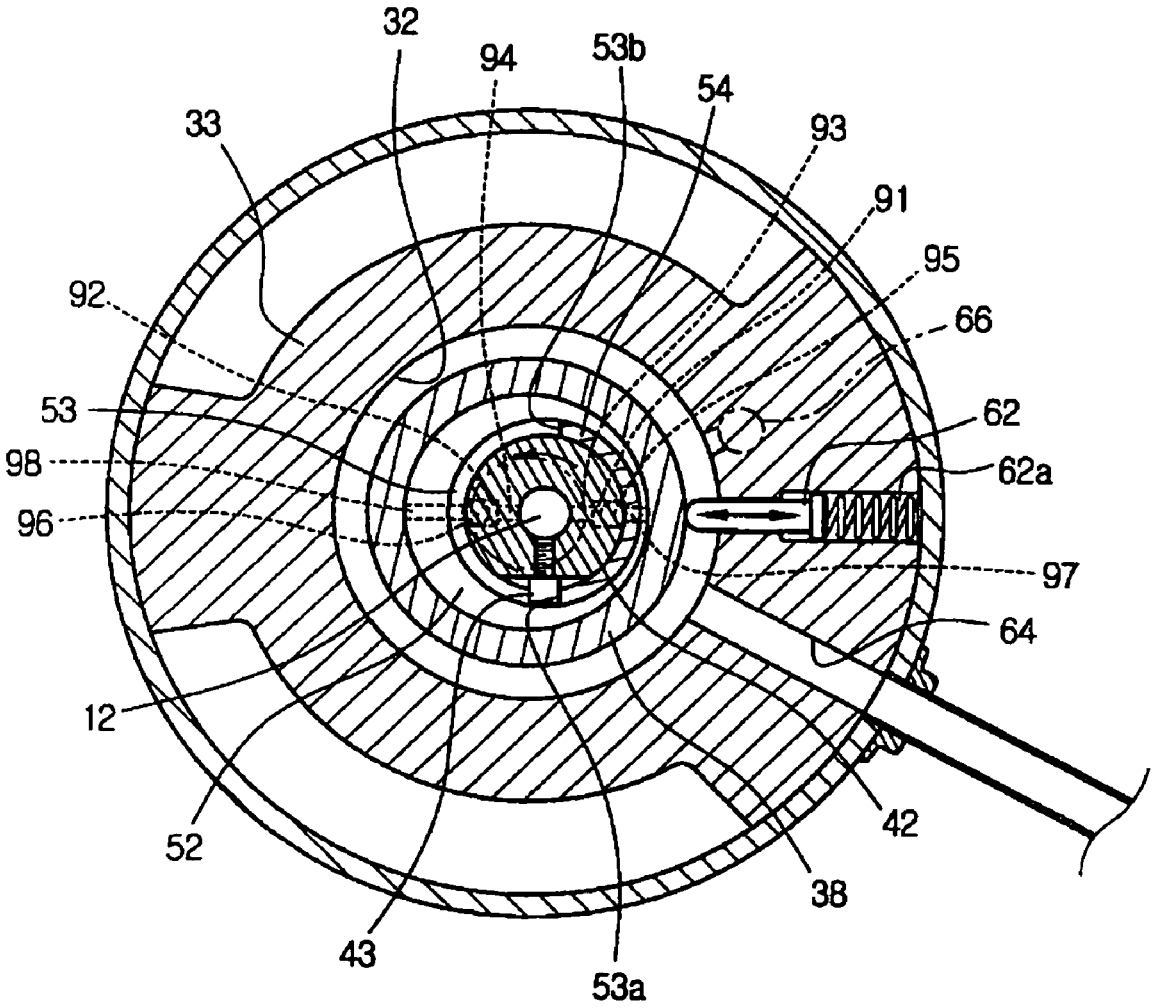
FIG. 4 is a sectional view, corresponding to FIG. 3, which shows a lower compression chamber in which an idle operation is executed by the eccentric unit of FIG. 2, when the rotating shaft rotates in the first direction.
Figure 5:
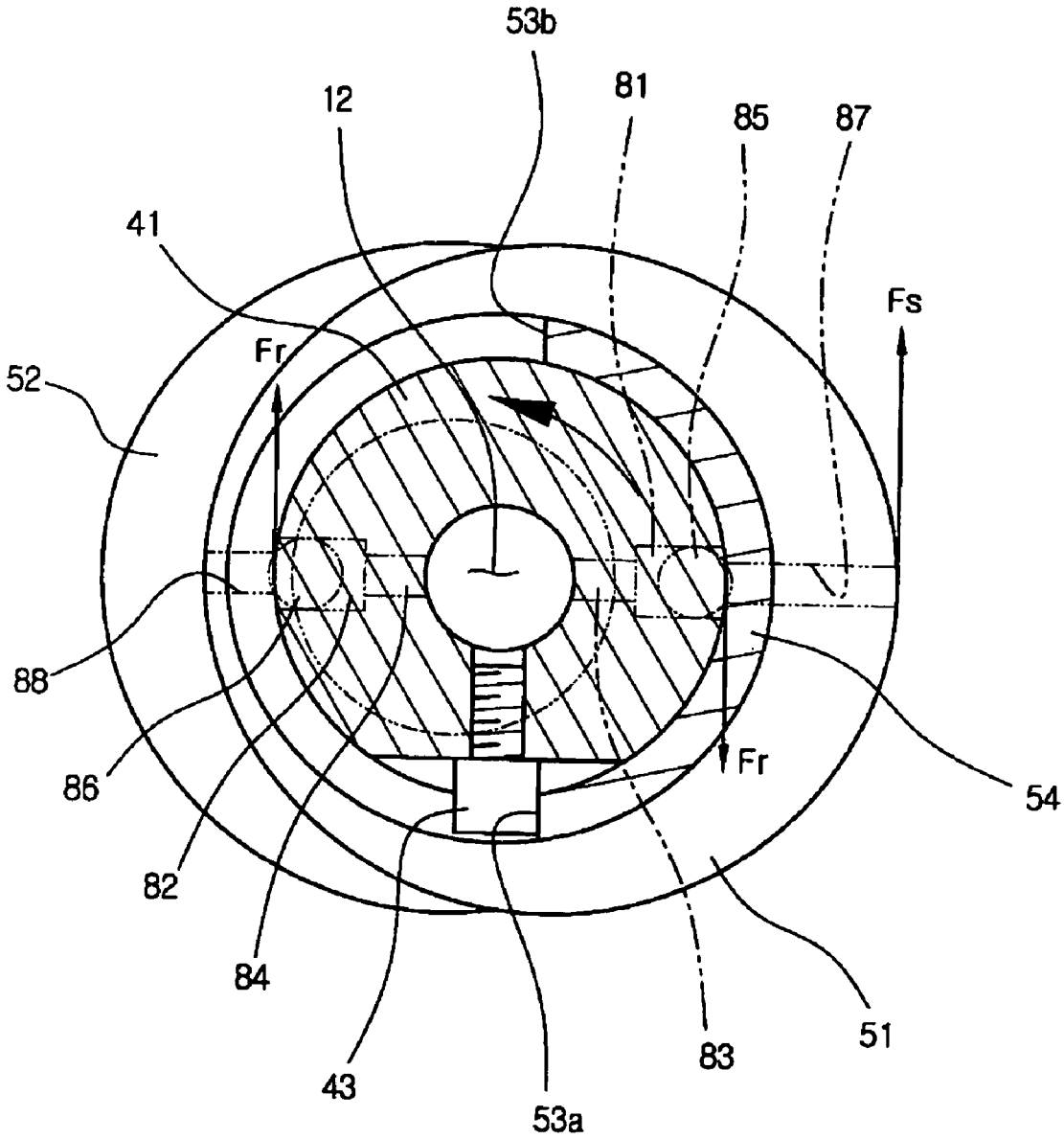
FIG. 5 is a sectional view showing an upper eccentric bush when the rotating shaft rotates in the first direction, in which the upper eccentric bush does not slip at a first predetermined position by the eccentric unit of FIG. 2.

FIG. 3 is a sectional view showing an upper compression chamber 31 in which a compression operation is executed without a slippage by the eccentric unit 40 of FIG. 2, when the rotating shaft 21 rotates in a first direction. FIG. 4 is a sectional view, corresponding to FIG. 3, which shows a lower compression chamber 32 in which an idle operation is executed by the eccentric unit 40 of FIG. 2, when the rotating shaft 21 rotates in the first direction. FIG. 5 is a sectional view showing an upper eccentric bush 51 when the rotating shaft 21 rotates in the first direction, in which the upper eccentric bush 51 does not slip at a predetermined position by the eccentric unit 40 of FIG. 2.

As illustrated in FIG. 3, when the rotating shaft 21 rotates in the first direction, which is counterclockwise in FIG. 3, the locking pin 43 projecting from the rotating shaft 21, rotates at a predetermined angle while engaging with the slot 53 which is provided at a predetermined position between the upper and lower eccentric bushes 51 and 52. When the locking pin 43 rotates at the predetermined angle, and is locked by the first end 53*a* of the slot 53, the upper eccentric bush 51 rotates along with the rotating shaft 21. At this time, since the lower eccentric bush 52 is integrally connected to the upper eccentric bush 51 by the connecting part 54, the lower eccentric bush 52 rotates along with the upper eccentric bush 51.

When the locking pin 43 contacts the first end 53*a* of the slot 53, the maximum eccentric part of the upper eccentric cam 41 is aligned with the maximum eccentric part of the upper eccentric bush 51. In this case, the upper eccentric bush 51 rotates while being maximally eccentric from the central axis C1-C1 of the rotating shaft 21. Thus, the upper roller 37 rotates while being in contact with an inner surface of the housing 33 defining the upper compression chamber 31, thus executing the compression operation.

Further, the first and second upper pockets 81 and 82 of the upper brake unit 80 are aligned with the first and second upper brake holes 87 and 88, respectively. The first and second upper brake balls 85 and 86 come into close contact with the first and second upper brake holes 87 and 88, respectively, by the pressure of the oil 11 fed through the oil passage 12 to the first and second upper connecting passages 83 and 84 and by the centrifugal force, thus the upper eccentric bush 51 rotates while being restrained by the upper eccentric cam 41.

Simultaneously, as illustrated in FIG. 4, the maximum eccentric part of the lower eccentric cam 42 contacts with the minimum eccentric part of the lower eccentric bush 52. In this case, the lower eccentric bush 52 rotates while being concentric with the central axis C1-C1 of the rotating shaft 21. Thus, the lower roller 38 rotates while being spaced apart from the inner surface of the housing 33, which defines the lower compression chamber 32, by a predetermined interval, thus the compression operation is not executed and, otherwise, an idle operation occurs therein.

Further, the first and second lower pockets 91 and 92 of the lower brake unit 90 are aligned with the first and second lower brake holes 97 and 98, respectively. At this time, the first and second lower brake balls 95 and 96 come into close contact with the first and second lower brake holes 97 and 98, respectively, by the pressure of the oil 11 fed through the oil passage 12 to the first and second lower connecting passages 93 and 94 and by the centrifugal force, thus the upper eccentric cam 41 rotates along with the upper eccentric bush 51 while being further restrained by the upper brake unit 80.

Therefore, when the rotating shaft 21 rotates in the first direction, the gas refrigerant flowing to the upper compression chamber 31 through the upper inlet port 63 is compressed by the upper roller 37 in the upper compression chamber 31 having a larger capacity than that of the lower compression chamber 32, and subsequently is discharged from the upper compression chamber 31 through the upper outlet port 65. However, the compression operation is not executed in the lower compression chamber 32 having a smaller capacity than that of the upper compression chamber 31. Therefore, the variable capacity rotary compressor is operated in a larger capacity compression mode.

Further, as shown in FIG. 3, when the upper roller 37 comes into contact with the upper vane 61, the operation of compressing the gas refrigerant is completed and an operation of drawing the gas refrigerant is started. At this time, some of the compressed gas, which was not discharged from the upper compression chamber 31 through the upper outlet port 65, returns to the upper compression chamber 31 and is re-expanded, thus applying a pressure to the upper roller 37 and the upper eccentric bush 51 in a rotating direction of the rotating shaft 21. The upper eccentric bush 51 rotates faster than the rotating shaft 21, thus causing the upper eccentric bush 51 to slip over the upper eccentric cam 41.

When the rotating shaft 21 further rotates in such a state, the locking pin 43 collides with the first end 53*a* of the slot 53 to make the upper eccentric bush 51 rotate at a same speed as that of the rotating shaft 21. At this time, noise may be generated and the locking pin 43 and the slot 53 may be damaged, due to a collision between the locking pin 43 and the slot 53.

However, the eccentric unit 40 prevents the upper eccentric bush 51 from slipping by an operation of the upper and lower brake units 80 and 90.

As illustrated in FIG. 5, when the upper roller 37 comes into contact with the upper vane 61, some of the gas refrigerant returns to the upper compression chamber 31 through the upper outlet port 65 and is re-expanded, thus generating a force $F_s$. The force $F_s$ acts on the upper eccentric bush 51 in the rotating direction of the rotating shaft 21 which is the first direction, thus the upper eccentric bush 51 slips over the upper eccentric cam 41. However, since the first and second upper brake balls 85 and 86 (see FIG. 3) come into close contact with the first and second upper brake holes 87 and 88 and the first and second lower brake balls 95 and 96 (see FIG. 4) come into close contact with the first and second lower brake holes 97 and 98 by the centrifugal force and the oil pressure, the upper and lower eccentric cams 41 and 42 and the upper and lower eccentric bushes 51 and 52 rotate while being restrained by each other. Thus, a resistance force $F_r$ to prevent a slippage of the upper eccentric bush 51 is generated by the first and second upper brake balls 85 and 86 and the first and second lower brake balls 95 and 96, thus maximally preventing the upper eccentric bush 51 from slipping.

Further, when the rotating shaft 21 stops rotating, the first and second upper brake balls 85 and 86 and the first and second lower brake balls 95 and 96 are not affected by the centrifugal force and the oil pressure. At this time, the first and second upper brake balls 85 and 86 move into the first and second upper pockets 81 and 82, respectively, while the first and second lower brake balls 95 and 96 move into the first and second lower pockets 91 and 92, respectively. In such a state, when the rotating shaft 21 rotates in the second direction, the locking pin 43 contacts the second end 53*b* of the slot 53, thus the compression operation is executed in the lower compression chamber 32. The compression operation executed in the lower compression chamber 32 will be described as follows.

Figure 6:
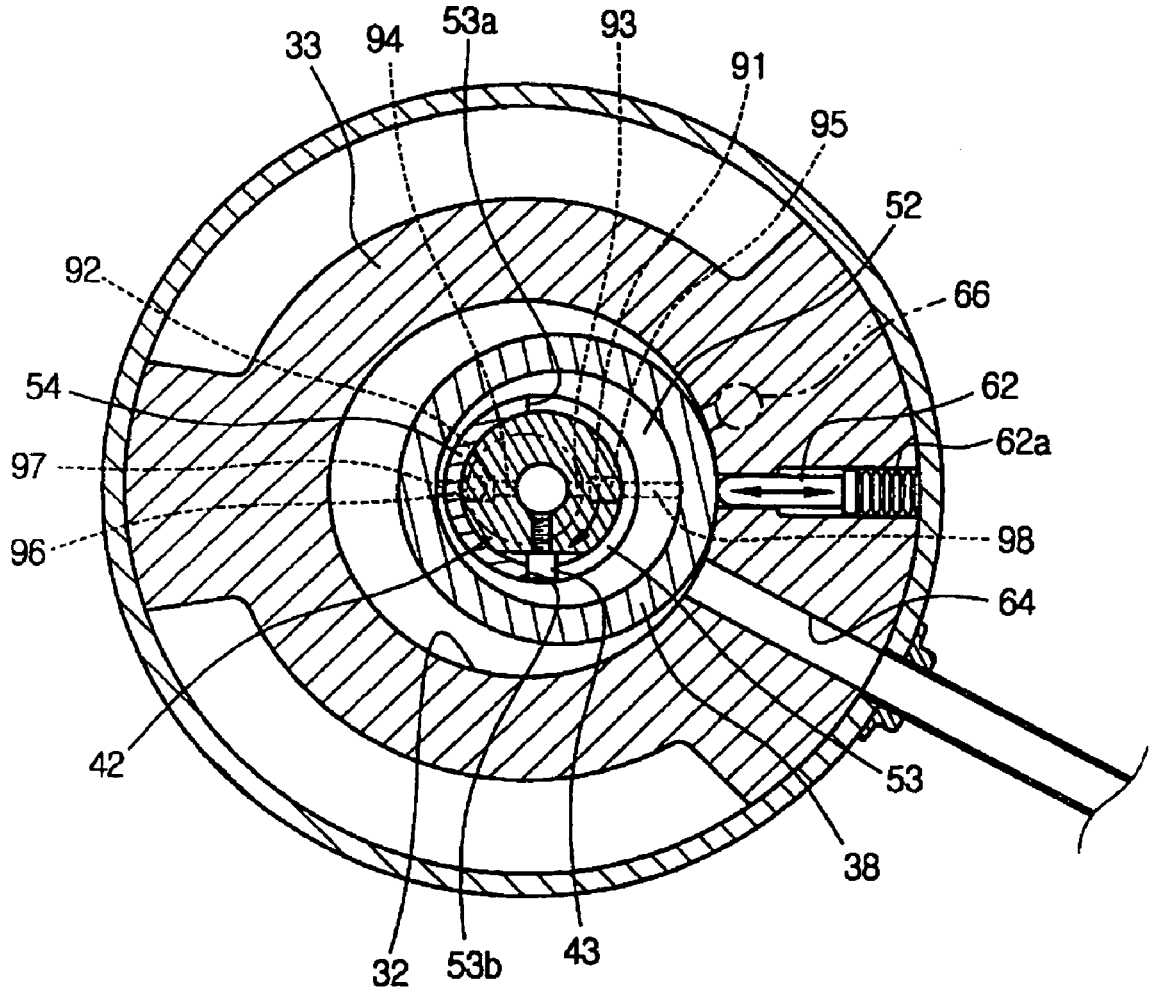
FIG. 6 is a sectional view showing a lower compression chamber in which the compression operation is executed without the slippage by the eccentric unit of FIG. 2, when the rotating shaft rotates in a second direction.
Figure 7:
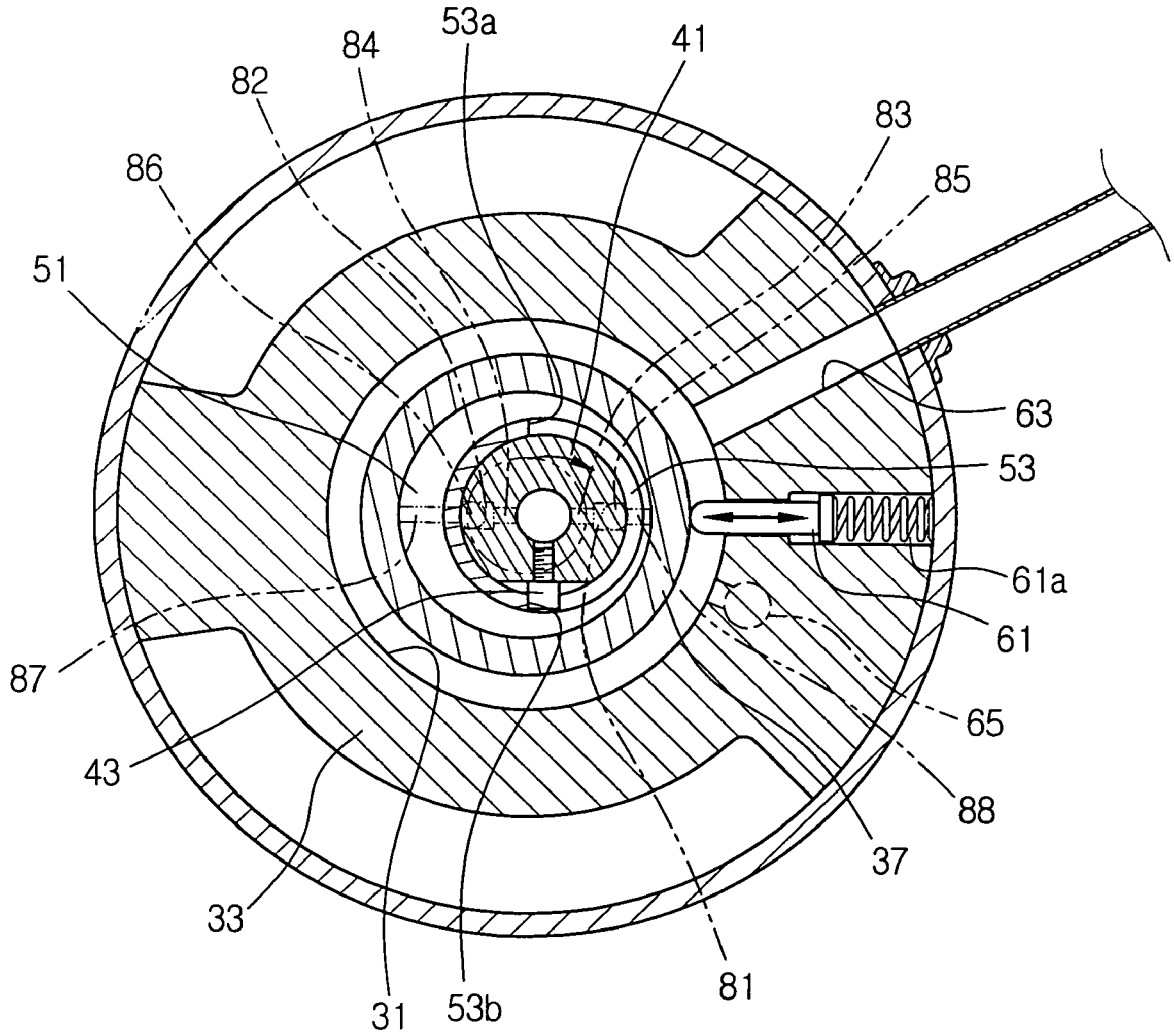
FIG. 7 is a sectional view, corresponding to FIG. 6, which shows the upper compression chamber in which the idle operation is executed by the eccentric unit of FIG. 2, when the rotating shaft rotates in the second direction.
Figure 8:
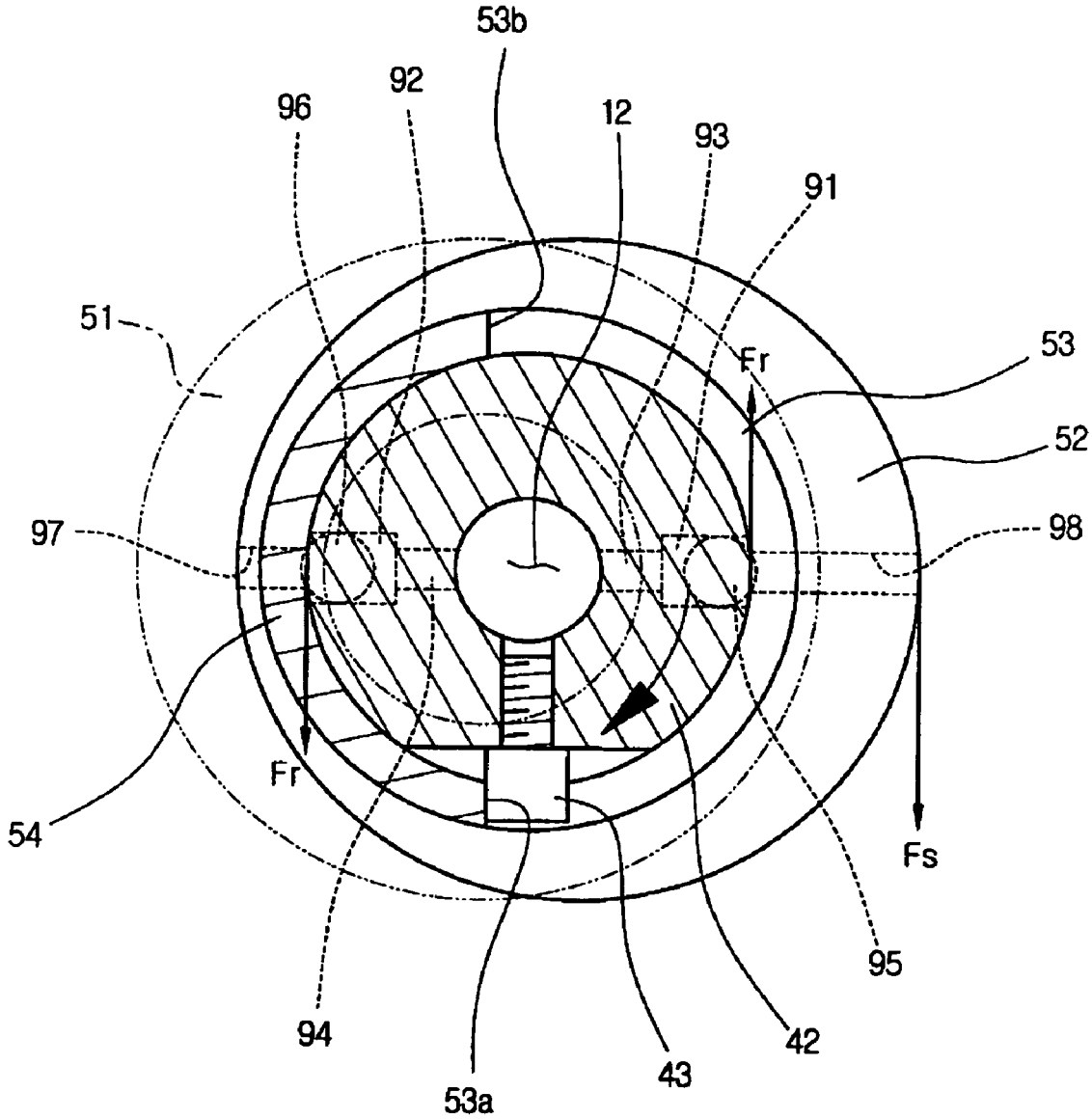
FIG. 8 is a sectional view showing a lower eccentric bush when the rotating shaft rotates in the second direction, in which the lower eccentric bush does not slip at a second predetermined position by the eccentric unit of FIG. 2.

FIG. 6 is a sectional view showing a lower compression chamber 32 where the compression operation is executed without a slippage by the eccentric unit 40 of FIG. 2, when the rotating shaft 21 rotates in a second direction. FIG. 7 is a sectional view, corresponding to FIG. 6, which shows the upper compression chamber 31 where an idle operation is executed by the eccentric unit 40 of FIG. 2, when the rotating shaft 21 rotates in the second direction. FIG. 8 is a sectional view showing a lower eccentric bush 52 when the rotating shaft 21 rotates in the second direction, in which the lower eccentric bush 52 does not slip at a predetermined position by the eccentric unit 40 of FIG. 2.

As illustrated in FIG. 6, when the rotating shaft 21 rotates in the second direction, which is clockwise in FIG. 6, the variable capacity rotary compressor is operated oppositely to the operation shown in FIGS. 3 and 4, thus causing the compression operation to be executed in only the lower compression chamber 32.

That is, while the rotating shaft 21 rotates in the second direction, the locking pin 43 projecting from the rotating shaft 21 comes into contact with the second end 53*b* of the slot 53, thus causing the upper and lower eccentric bushes 51 and 52 to rotate in the second direction.

In this case, the maximum eccentric part of the lower eccentric cam 42 contacts the maximum eccentric part of the lower eccentric bush 52, thus the lower eccentric bush 52 rotates while being maximally eccentric from the central axis C1-C1 of the rotating shaft 21. Therefore, the lower roller 38 rotates while being in contact with the inner surface of the housing 33 which defines the lower compression chamber 32, thus executing the compression operation.

Simultaneously, as illustrated in FIG. 7, the maximum eccentric part of the upper eccentric cam 41 contacts with the minimum eccentric part of the upper eccentric bush 51. In this case, the upper eccentric bush 51 rotates while being concentric with the central axis C1-C1 of the rotating shaft 21. Thus, the upper roller 37 rotates while being spaced apart from the inner surface of the housing 33, which defines the upper compression chamber 31, by a predetermined interval, thus the compression operation is not executed and otherwise an idle operation is executed.

Therefore, the gas refrigerant flowing to the lower compression chamber 32 through the lower inlet port 64 is compressed by the lower roller 38 in the lower compression chamber 32 having a smaller capacity than that of the upper compression chamber 31, and subsequently is discharged from the lower compression chamber 32 through the lower outlet port 66. However, the compression operation is not executed in the upper compression chamber 31 having a larger capacity than that of the lower compression chamber 32. Therefore, the rotary compressor is operated in a smaller capacity compression mode.

Further, as shown in FIG. 6, when the lower roller 38 comes into contact with the lower vane 62, an operation of compressing the gas refrigerant is completed and an operation of drawing the gas refrigerant starts. At this time, some of the compressed gas, which was not discharged from the lower compression chamber 32 through the lower outlet port 66, returns to the lower compression chamber 32 and is re-expanded, thus applying a pressure to the lower roller 38 and the lower eccentric bush 52 in a rotating direction of the rotating shaft 21. The lower eccentric bush 52 rotates faster than the rotating shaft 21, thus causing the lower eccentric bush 52 to slip over the lower eccentric cam 42.

When the rotating shaft 21 further rotates in such a state, the locking pin 43 collides with the second end 53*b* of the slot 53 to make the lower eccentric bush 52 rotate at a same speed as that of the rotating shaft 21. Further, noise may be generated and the locking pin 43 and the slot 53 may be damaged, due to the collision between the locking pin 43 and the slot 53.

However, the upper and lower eccentric bushes 51 and 52 are restrained in a common manner as those of the upper and lower eccentric bushes 51 and 52, which are restrained by the upper and lower brake units 80 and 90 when the rotating shaft 21 rotates in the first direction, thus preventing the slippage and the collision.

Thus, the eccentric unit 40 prevents the lower eccentric bush 52 from slipping by the operation of the upper and lower brake units 80 and 90.

As illustrated in FIG. 8, when the lower roller 38 comes into contact with the lower vane 62, some of the gas refrigerant returns to the lower compression chamber 32 through the lower outlet port 66 and is re-expanded, thus generating the force $F_s$. The force $F_s$ acts on the lower eccentric bush 52 in the rotating direction of the rotating shaft 21 which is the second direction, thus the lower eccentric bush 52 slips over the lower eccentric cam 42. However, since the second and first lower brake balls 96 and 95 (see FIG. 6) come into close contact with the first and second lower brake holes 97 and 98 and the second and first upper brake balls 86 and 85 (see FIG. 7) come into close contact with the first and second upper brake holes 87 and 88 by the centrifugal force and the oil pressure, the lower and upper eccentric cams 42 and 41 and the lower and upper eccentric bushes 52 and 51 are rotated while being restrained by each other. Thus, a resistance force $F_r$ to prevent the slippage of the lower eccentric bush 52 is generated by the first and second lower brake balls 95 and 96 and the first and second upper brake balls 85 and 86, thus maximally preventing the lower eccentric bush 52 from slipping.

Further, when the rotating shaft 21 stops rotating, the first and second lower brake balls 95 and 96 and the first and second upper brake balls 85 and 86 are not affected by the centrifugal force and the oil pressure. At this time, the first and second upper brake balls 85 and 86 are moved into the first and second upper pockets 81 and 82, respectively, while the first and second lower brake balls 95 and 96 are moved into the first and second lower pockets 91 and 92, respectively. In such a state, when the rotating shaft 21 is rotated again in the first direction, the locking pin 43 contacts the first end 53*a* of the slot 53, thus the compression operation is executed in the upper compression chamber 31.

As is apparent from the above description, a variable capacity rotary compressor is provided, which is designed to execute a compression operation in either of upper and lower compression chambers having different interior capacities thereof by an eccentric unit which rotates in the first direction or the second direction, thus varying a compression capacity of the variable capacity rotary compressor as desired.

Further, a variable capacity rotary compressor is provided, which has an upper brake unit between an upper eccentric cam and an upper eccentric bush, and has a lower brake unit between a lower eccentric cam and a lower eccentric bush, thus preventing the upper eccentric bush or lower eccentric bush from slipping when an eccentric unit rotates in the first direction or the second direction, therefore allowing the upper and lower eccentric bushes to smoothly rotate.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A variable capacity rotary compressor, comprising:

upper and lower compression chambers having different interior capacities thereof;

a rotating shaft passing through the upper and lower compression chambers;

upper and lower eccentric cams provided on the rotating shaft;

upper and lower eccentric bushes fitted over the upper and lower eccentric cams, respectively;

a slot provided at a first predetermined position between the upper and lower eccentric bushes;

a locking pin to change a position of the upper or lower eccentric bush to a maximum eccentric position, in cooperation with the slot; and upper and lower brake units simultaneously operated to prevent either of the upper and lower eccentric bushes from slipping over the upper eccentric cam or the lower eccentric cam, respectively.

2. The rotary compressor according to claim 1, wherein the upper brake unit comprises:

first and second upper pockets formed at second predetermined positions of the upper eccentric cam, first and second upper brake balls movably set in the first and second upper pockets, respectively, and first and second upper brake holes formed at third predetermined positions of the upper eccentric bush such that the first and second upper brake holes have diameters smaller than those of the first and second upper brake balls, respectively; and the lower brake unit comprises:

first and second lower pockets formed at fourth predetermined positions of the lower eccentric cam, first and second lower brake balls movably set in the first and second lower pockets, respectively, and first and second lower brake holes formed at fifth predetermined positions of the lower eccentric bush such that the first and second lower brake holes have diameters smaller than those of the first and second lower brake balls, respectively.

3. The rotary compressor according to claim 2, wherein the locking pin projects from the rotating shaft at a position between the upper and lower eccentric cams, and the slot is provided between the upper and lower eccentric bushes to engage with the locking pin, and has a length to allow, an angle between a first line extending from a first end of the slot to a center of the rotating shaft and a second line extending from a second end of the slot to the center of the rotating shaft, to be 180°.

4. The rotary compressor according to claim 3, wherein the first and second upper pockets are formed on the upper eccentric cam to be opposite to each other, and the first and second lower pockets are formed on the lower eccentric cam to be opposite to each other at common angular positions as those of the first and second upper pockets.

5. The rotary compressor according to claim 4, wherein the first and second upper brake holes are formed on the upper eccentric bush to be opposite to each other, and the first and second lower brake holes are formed on the lower eccentric bush to be opposite to each other at common angular positions as those of the first and second upper brake holes.

6. The rotary compressor according to claim 5, wherein, when the locking pin contacts the first end of the slot and the upper eccentric bush rotates to be maximally eccentrically from the rotating shaft, the first and second upper brake balls are inserted into the first and second upper brake holes, respectively, and the first and second lower brake balls are inserted into the first and second lower brakes holes, respectively, by a centrifugal force to prevent the upper eccentric bush from slipping.

7. The rotary compressor according to claim 5, wherein, when the locking pin contacts the second end of the slot and the lower eccentric bush rotates to be maximally eccentrically from the rotating shaft, the first and second upper brake balls are inserted into the second and first upper brake holes, respectively, and the first and second lower brake balls are inserted into the second and first lower brakes holes, respectively, by a centrifugal force to prevent the lower eccentric bush from slipping.

8. The rotary compressor according to claim 5, further comprising:

an oil passage axially formed along the rotating shaft;

first and second upper connecting passages, the first and second upper pockets communicate with the oil passage via the first and second upper connecting passages; and first and second lower connecting passages, the first and second lower pockets communicate with the oil passage via the first and second lower connecting passages to allow an oil pressure and the centrifugal force to act on the first and second upper brake balls and the first and second lower brake balls.

9. A variable capacity rotary compressor, comprising:

upper and lower compression chambers having different interior capacities thereof;

a rotating shaft passing through the upper and lower compression chambers;

upper and lower eccentric cams provided on the rotating shaft to be eccentric from the rotating shaft in a common direction;

upper and lower eccentric bushes fitted over the upper and lower eccentric cams, respectively, to be eccentric from the rotating shaft in opposite directions;

a slot provided at a first predetermined position between the upper and lower eccentric bushes, and having first and second ends thereof;

a locking pin to contact either the first end or the second end of the slot, according to a rotating direction of the rotating shaft, to change a position of the upper eccentric bush or the lower eccentric bush to a maximum eccentric position; and upper and lower brake units simultaneously operated to prevent either of the upper and lower eccentric bushes from slipping over the upper eccentric cam or the lower eccentric cam, respectively.

10. The rotary compressor according to claim 9, wherein the upper brake unit comprises:

first and second upper pockets formed at second predetermined positions of the upper eccentric cam, first and second upper brake balls movably set in the first and second upper pockets, respectively, and first and second upper brake holes formed at the upper eccentric bush and having diameter smaller than that of each of the first and second upper brake balls; and the lower brake unit comprises:

first and second lower pockets formed at fourth predetermined positions of the lower eccentric cam, first and second lower brake balls movably set in the first and second lower pockets, respectively, and first and second lower brake holes formed at fifth predetermined positions of the lower eccentric bush to have a diameter smaller than that of each of the first and second lower brake baits.

11. The rotary compressor according to claim 10, wherein the first and second upper pockets are formed on the upper eccentric cam to be opposite to each other, and the first and second lower pockets are formed on the lower eccentric cam to be opposite to each other at common angular positions as those of the first and second upper pockets.

12. The rotary compressor according to claim 11, wherein the first and second upper brake holes are formed on the upper eccentric bush to be opposite to each other, and the first and second lower brake holes are formed on the lower eccentric bush to be opposite to each other at common angular positions as those of the first and second upper brake holes.

13. The rotary compressor according to claim 12, further comprising:

an oil passage axially formed along the rotating shaft;

first and second upper connecting passages, the first and second upper pockets communicate with the oil passage via the first and second upper connecting passages; and first and second lower connecting passages, the first and second lower pockets communicate with the oil passage via the first and second lower connecting passages to allow an oil pressure and the centrifugal force to act on the first and second upper brake balls and the first and second lower brake balls.

14. The rotary compressor according to claim 10, wherein when the locking pin contacts the first end of the slot and the rotating shaft rotates along with the upper and lower eccentric bushes in a first direction, the first upper pocket is aligned with the first upper brake hole and the second upper pocket is aligned with the second upper brake hole such that the first and second upper brake balls are inserted into the first and second upper brake holes, respectively, to prevent the upper eccentric bush from slipping and when the locking pin contacts the second end of the slot and the rotating shaft rotates along with the upper and lower eccentric bushes in a second direction, the first upper pocket is aligned with the second upper brake hole and the second upper pocket is aligned with the first upper brake hole such that the first and second upper brake balls are inserted into the second and first upper brake holes, respectively, to prevent the lower eccentric bush from slipping.

15. A variable capacity rotary compressor having upper and lower compression chambers, comprising:

upper and lower eccentric cams retractably provided in the upper and lower compression chambers, respectively;

upper and lower eccentric bushes fitted over the upper and lower eccentric cams, respectively;

a slot formed between the upper and lower eccentric bushes;

a locking pin to change a position of the upper or lower eccentric bush to a maximum eccentric position, in cooperation with the slot; and upper and lower brake units operated to prevent the upper and lower eccentric bushes from slipping with respect to the upper eccentric cam and the lower eccentric cam, respectively.

16. The rotary compressor according to claim 15, wherein the upper and lower compression chambers have different compression capacities.

17. The rotary compressor according to claim 15, wherein:

the upper brake unit comprises:

first and second upper projectable parts projectable from predetermined positions of the upper eccentric cam, and first and second upper receiving parts formed in the upper eccentric bush to receive the first and second upper projectable parts when the first and second upper projectable parts are projected; and the lower brake unit comprises:

first and second lower projectable parts projectable from predetermined positions of the lower eccentric cam, and first and second lower receiving parts formed in the lower eccentric bush to receive the first and second lower projectable parts when the first and second lower projectable parts are projected.

18. The rotary compressor according to claim 17, further comprising:

a rotating shaft rotating the upper and lower eccentric bushes;

an oil passage formed extending along the rotating shaft; and a plurality of connecting passages, the first and second upper projectable parts and the first and second lower projectable parts communicating with the oil passage via the plurality of connecting passages to allow an oil pressure and a centrifugal force of the rotating upper and lower eccentric bushes to act on the first and second upper projectable parts and the first and second lower projectable parts to project into respective ones of the first and second upper receiving parts and the first and second lower receiving parts.

19. The rotary compressor according to claim 15, wherein the upper and lower compression chambers comprise upper and lower inlet ports, respectively, thereat; the rotary compressor further comprising:

first and second intake paths to supply refrigerant to the upper inlet port of the upper compression chamber and the lower inlet port of the lower compression chamber, respectively;

and a path control unit to open or to close the first or second intake paths and to allow a supply of the refrigerant to only one of the upper inlet port of the upper compression chamber and the lower inlet port of the lower compression chamber such that a compression operation is executed in the refrigerant supplied compression chamber.

20. The rotary compressor according to claim 19, wherein the path control unit comprises:

a valve unit installed in the path control unit to be movable extending in a first direction to open one of the first and second intake paths by a difference in a pressure between the first intake path connected to the upper inlet port and the second intake path connected to the lower inlet port to supply the refrigerant to only one of the upper and lower inlet ports.

21. The rotary compressor according to claim 15, further comprising:

a rotating shaft communicating with the upper and lower eccentric bushes such that when the rotating shaft rotates in a first direction or a second direction, the upper and lower eccentric bushes are not rotated until the locking pin comes into contact with one of first and second ends of the slot and when the locking pin comes into contact with the first end or the second end of the slot, the upper and lower eccentric bushes rotate in the first direction or the second direction along with the rotating shaft.

22. A variable capacity rotary compressor having upper and lower compression chambers, comprising:

upper and lower eccentric cams rotatably provided in the upper and lower compression chambers, respectively;

upper and lower eccentric bushes fitted over the upper and lower eccentric cams, respectively, and changeably configured such that a compression operation is provided in one of the upper and lower compression chambers and an idle operation is provided in a remaining one of the upper and lower compression chambers; and upper and lower brake units operated to prevent the upper and lower eccentric bushes from slipping with respect to the upper and lower eccentric cams, respectively.

23. A variable capacity rotary compressor including upper and lower compression chambers having different interior capacities thereof, comprising:

upper and lower eccentric cams rotatably provided in the upper and lower compression chambers, respectively, the upper and lower eccentric cams being eccentric in the upper and lower compression chambers in a common direction;

upper and lower eccentric bushes fitted over the upper and lower eccentric cams, respectively, and being eccentric in the upper and lower compression chambers in opposite directions;

a slot provided between the upper and lower eccentric bushes, and having first and second ends;

a locking pin to change a position of the upper or lower eccentric bush to a maximum eccentric position, in cooperation with the slot; and upper and lower brake units operated to prevent the upper and lower eccentric bushes from slipping with respect to the upper and lower eccentric cams, respectively.

* * * * *

UNITED STATES PATENT AND TRADEMARK OFFICE

CERTIFICATE OF CORRECTION

PATENT NO. : 7,223,081 B2
APPLICATION NO. : 10/830016
DATED : May 29, 2007
INVENTOR(S) : In Ju Lee et al.

It is certified that error appears in the above-identified patent and that said Letters Patent is hereby corrected as shown below:

Column 16, Line 22, change “baits” to --balls--.

Signed and Sealed this

Thirtieth Day of October, 2007

JON W. DUDAS
*Director of the United States Patent and Trademark Office*